US006622400B2

(12) United States Patent
Bollard

(10) Patent No.: US 6,622,400 B2
(45) Date of Patent: Sep. 23, 2003

(54) SPORTS BOOT HAVING A TRANSVERSELY ADJUSTABLE TIGHTENING DEVICE

(75) Inventor: Patrick Bollard, Veyrier du Lac (FR)

(73) Assignee: Salomon S.A., Metz-Tessy (FR)

( * ) Notice: Subject to any disclaimer, the term of this patent is extended or adjusted under 35 U.S.C. 154(b) by 44 days.

(21) Appl. No.: 10/051,163

(22) Filed: Jan. 22, 2002

(65) Prior Publication Data

US 2002/0095821 A1 Jul. 25, 2002

(30) Foreign Application Priority Data

Jan. 24, 2001 (FR) ..... 01 01258

(51) Int. Cl.[7] ..... A43B 5/04; A43C 11/00; A43C 11/14

(52) U.S. Cl. ..... 36/50.5; 36/50.1; 24/68 SK; 24/69 SK; 24/70 SK; 24/71 SK

(58) Field of Search ..... 36/50.5, 50.1; 24/68 SK, 69 SK, 70 SK, 71 SK

(56) References Cited

U.S. PATENT DOCUMENTS

| | | | | | |
|---|---|---|---|---|---|
| 4,541,147 | A | * | 9/1985 | Olivieri | 24/68 SK |
| 4,674,156 | A | * | 6/1987 | Olivieri | 24/71 SK |
| 4,761,859 | A | * | 8/1988 | Calabrigo | 24/68 SK |
| 4,893,384 | A | * | 1/1990 | Bidoia et al. | 24/68 SK |
| 5,586,367 | A | * | 12/1996 | Benoit | 24/68 SK |
| 5,701,639 | A | * | 12/1997 | Chen | 24/71 SK |
| 5,715,582 | A | * | 2/1998 | Zorzi | 24/71 SK |
| 5,983,531 | A | | 11/1999 | Chaigne et al. | |

FOREIGN PATENT DOCUMENTS

| | | |
|---|---|---|
| CH | 668682 | 1/1989 |
| DE | 2414439 | 10/1975 |
| EP | 0895729 | 2/1999 |
| FR | 2755834 | 5/1998 |

* cited by examiner

*Primary Examiner*—Anthony D. Stashick
(74) *Attorney, Agent, or Firm*—Greenblum & Bernstein, P.L.C.

(57) ABSTRACT

A sports boot, especially a ski boot of the type having a tightening device adapted to keep two flaps close together and including a first portion constituted by an operating lever which has at least one connection element and is carried by a plate affixed to one of the flaps to be brought closer together, and a second portion located on the other flap and constituted by a second connection element corresponding to the first and controlled during latching or unlatching by means of the lever which includes a structure to align the two portions so as to position them on a single working line.

7 Claims, 3 Drawing Sheets

SPORTS BOOT HAVING A TRANSVERSELY ADJUSTABLE TIGHTENING DEVICE

CROSS-REFERENCE TO RELATED APPLICATION

This application is based upon French Patent Application No. 01 01258, filed Jan. 24, 2001, the disclosure of which is hereby incorporated-by-reference thereto in its entirety, and the priority of which is hereby claimed under 35 U.S.C. §119.

BACKGROUND OF THE INVENTION

1. Field of the Invention

The present invention relates to a sports boot, more particularly a ski boot, of the type having a tightening device.

Such a tightening device is adapted to keep two flaps of a foot insertion area of the boot close together, In a known manner, a device of this type includes a first portion constituted by an operating lever including at least one connection element and carried by a base plate affixed to one of the flaps to be brought closer together, and a second portion located on the other flap and constituted by a second connection element corresponding to the first and controlled during latching or unlatching by means of the lever.

2. Description of Background and Relevant Information

With devices of the aforementioned type, it is apparent that the user's comfort cannot always be achieved. Indeed, in these devices, the lever and connection elements which constitute them are arbitrarily positioned on a working line corresponding to a standard morphology of a foot. However, it is apparent that differences exist from one individual to the next; thus, the aforementioned working line can be offset with respect to the bending folds of the foot, for example, after the flaps of the boot are tightened. Also, the morphology of the foot may be such that, in certain cases, it causes the misalignment of the lever in relation to the connection element, which can generate variations in tightening during use of the boot.

To remedy this disadvantage, it is known to make operating levers that are associated with means for aligning the two portions of the tightening device so as to position them on a single working line.

The German document No. 24 14439 describes such means constituted of a fixed notched slide in which the base of a tightening lever carrying a traction cable moves as a function of the adjustment to be made.

The linkage between the lever and the notched slide is carried out by means of two pieces pinching a plate in which the fixed guiding slide is obtained. An elastic return spring, which requires the use of a fine instrument to lift it before a new adjustment can be made, is associated with these pieces.

This device is nothing short of complex and delicate, especially with respect to the adjusting operation.

SUMMARY OF THE INVENTION

An object of the present invention is to overcome all of the aforementioned disadvantages and, to this end, the invention relates to a sports boot, especially a ski boot of the type having a tightening device adapted to keep two flaps of a foot insertion area close together and including a first portion constituted by an operating lever which includes at least one connection element and is carried by a plate affixed to one of the flaps to be brought closer together, and a second portion located on the other flap and constituted by a second connection element of his lever which has means for aligning the two portions so as to position them on a single working line, wherein the operating lever is attached on the plate, which is fixed, by means of a movable cap forming a base connected to the plate by at least one assembling and guiding pin extending through a corresponding hole of the cap and an arc of a circle slot of the plate in which at least one pin is adapted to move angularly, in a transverse direction, when adjusting the alignment of the portions of the tightening device, which occurs by sliding the cap carrying the lever with respect to the base plate.

The advantage of such a solution according to the invention lies in the fact that the connection between the movable cap and the fixed plate occurs without any intermediary element whose weakening may cause a clearance between the two pieces.

That is the case in the aforementioned cited prior art document which uses an elastically deformable element between equivalent pieces.

The present invention also relates to the characteristics which will become apparent from the description that follows, and which must be considered separately or according to all of their possible technical combinations.

BRIEF DESCRIPTION OF DRAWINGS

This description, provided by way of a non-limiting example, will help to better understand how the invention can be embodied, with reference to the annexed drawings, in which.

DETAILED DESCRIPTION OF THE INVENTION

Figure 1:
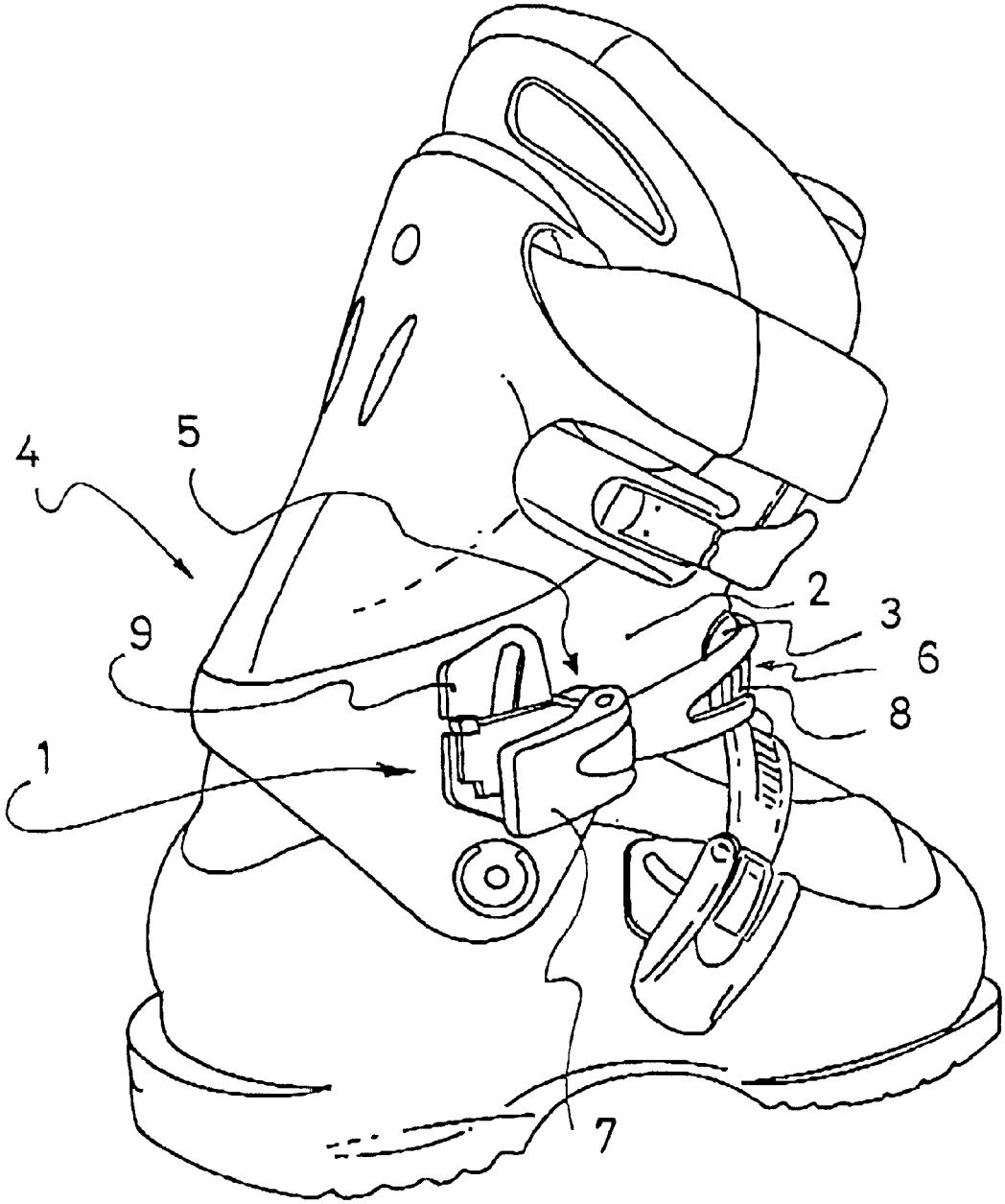
FIG. 1 shows a perspective view of an alpine ski boot, according to an example of application, provided with a tightening device according to the invention.

The tightening device, generally designated by the reference numeral 1 in FIG. 1, is adapted to keep close together two flaps 2, 3 of a ski boot also generally designated by the reference numeral 4.

The tightening device 1 includes a first portion 5 and a second portion 6.

The first portion 5 is constituted by an operating lever 7 which includes at least one connection element 8 and which is carried by a plate 9 affixed to one 2 of the flaps 2, 3.

The second portion 6 of the tightening device 1 is located on the other flap 3, and it is constituted by a second connection element corresponding to the first and controlled during latching and unlatching by the lever 7.

With respect to this second connection element, it can be a rack with which a corresponding notch constituting the connection element 8 of the lever 7 cooperates.

The operating lever 7 includes a structure to align the portions 5 and 6 of the tightening device 1 so as to position them on a single working line.

According to the invention, the operating lever 7 is attached on the plate 9, which is fixed, by means of a movable cap 10 forming a base connected to the plate 9 by at least one assembling and guiding pin 11 extending through a corresponding hole of the cap 10 and an arch of a circle slot 13 of the base plate 9 in which at least one pin 11 is adapted to move angularly, in a transverse direction, when adjusting the alignment of the portions 5 and 6 of the tightening device 1, which occurs by sliding the cap 10 carrying the lever 7 with respect to the base plate 9.

The cap 10 is constituted by a flat element having, on both of its longitudinal sides, ears 14 rising perpendicularly, or substantially perpendicularly, with respect to the plane of the flap 10, parallel to one another, or substantially parallel, facing one another, and each including holes 15 enabling the journal of the lever 7 extending along axis 16, which can take the form of an axle or pin.

In addition, the base plate 9 is generally flat, at least in the zones of contact with the cap 10 so as to enable sliding of one with respect to the other.

Figure 2:
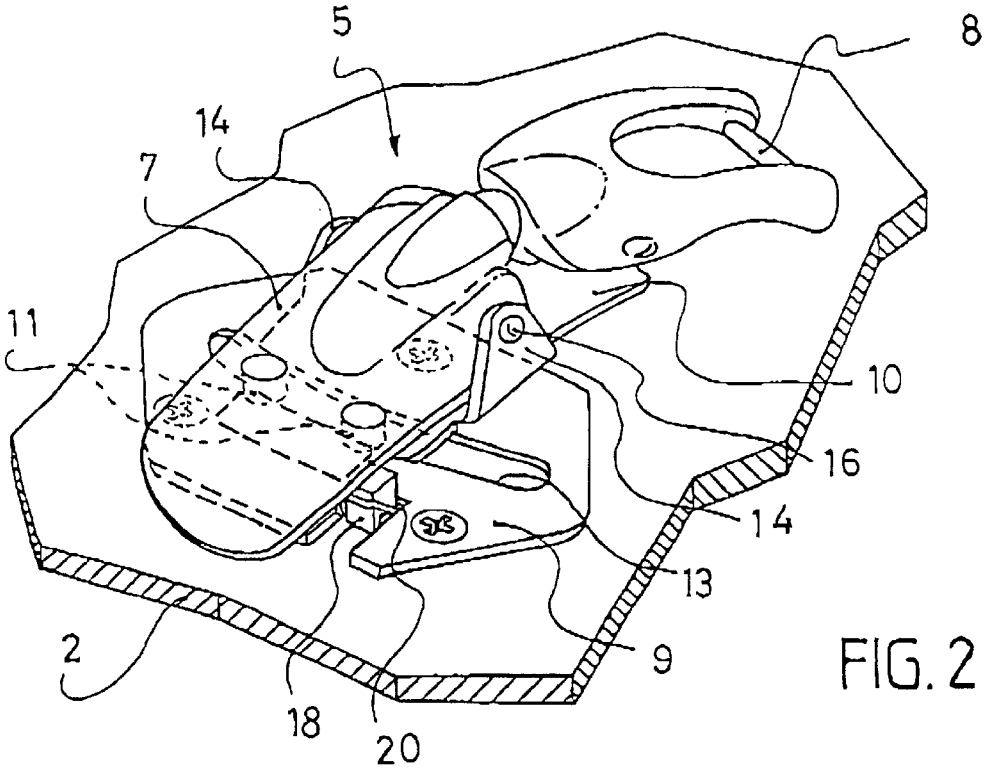
FIG. 2 shows a perspective view of an operating lever equipped with alignment means according to the invention.
Figure 3:
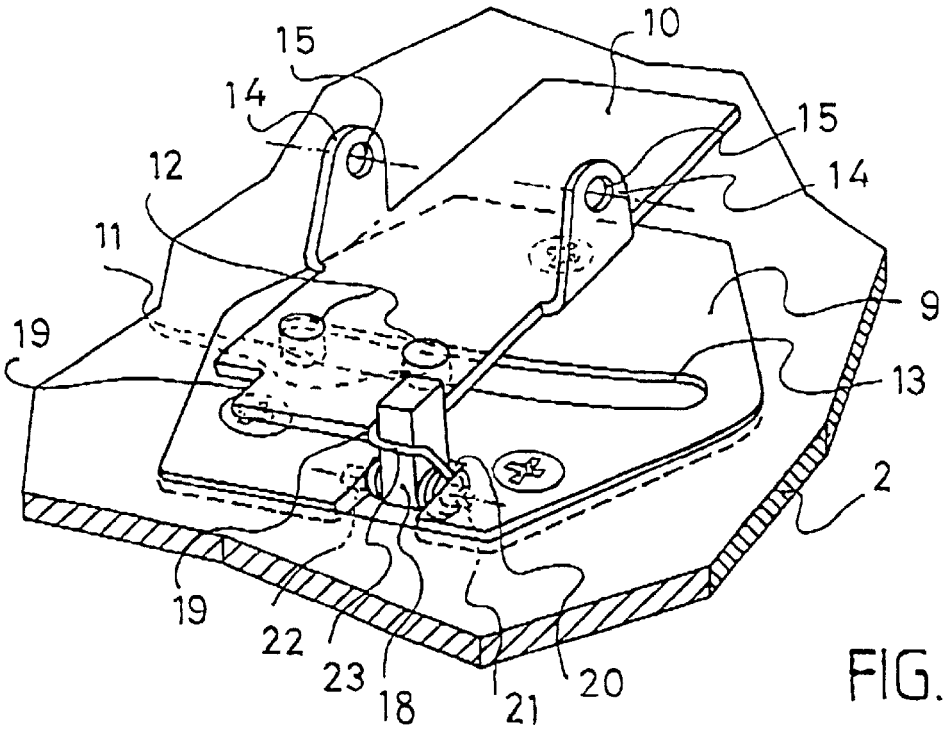
FIG. 3 is a view according to FIG. 2, from which the operating lever has been removed for better understanding.

According to the example of embodiment shown in FIGS. 2 and 3, the linkage of the cap 10 with the base plate 9 occurs by means of two pins 11 arranged symmetrically between them so as to allow a sliding clearance therebetween.

According to this same example, the presence of two pins 11 adapted to be translationally driven in the groove 13 of the plate 9 prevents any rotation of the cap 10 around either of the pins, thus providing it with an unquestionable stability during displacement in the slot 13.

Figure 4:
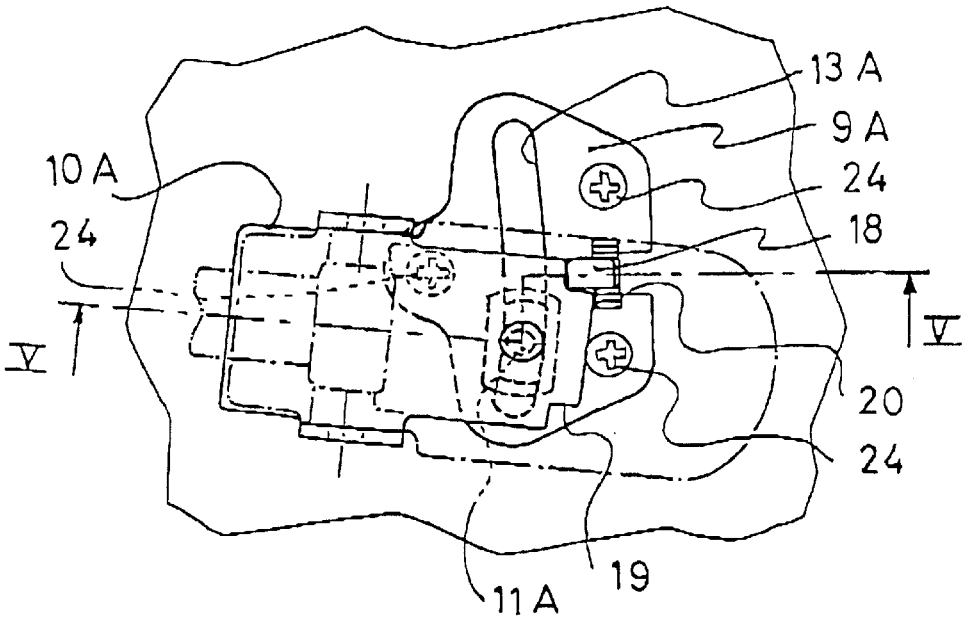
FIG. 4 is a view of the alignment means according to an alternative embodiment.
Figure 5:
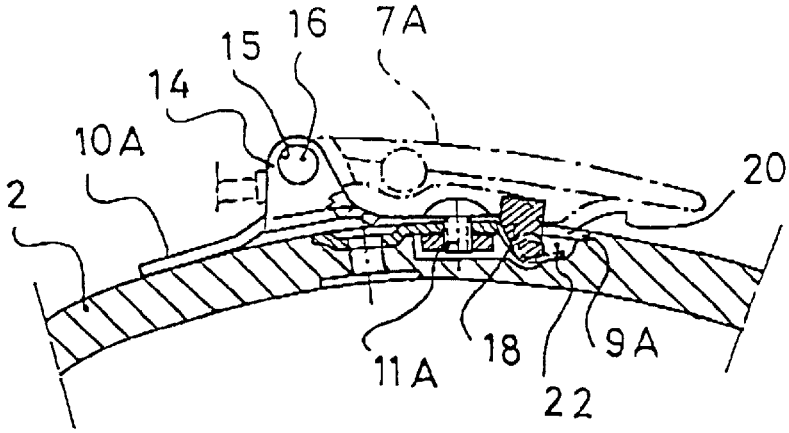
FIG. 5 is a cross-sectional view along the line V—V of FIG. 4.

The embodiment shown in FIG. 4 differs from the preceding essentially in that the linkage of the cap 10A with the plate 9A occurs by means of a single assembling pin 11, 11A moving angularly in the slot 13A of the plate 9A with respect to a fixed axle 17A of journal of the cap 10A with respect to the flaps of the boot.

Whatever the aforementioned example, the adjustment of the angular movement of the cap 10, 10A, therefore of the lever 7, 7A with respect to the plate 9, 9A, occurs between two end positions of the slot 13, 13A of the latter, the holding in either of the selected positions being done by an intermediary indexing element 18 arranged retractably on the plate 9, 9A and capable of being positioned in corresponding cutouts 19 obtained on both sides of the cap 10, 10A, in its end zone directed toward the indexing element 18.

According to the present embodiment, the indexing element 18 is constituted by a non-deformable finger journalled by its widened base 21 in a corresponding housing 22 obtained in the thickness of the wall of the boot 4, at right angles with a narrower opening 20 obtained in the plate 9, 9A, so as to confine the indexing element 18 by its base and to enable the free overlapping of the finger extending it in the opening 20.

According to the present embodiment, the widened base of the indexing element 18 is cylindrical, whereas the finger extending it is parallelepipedic.

As shown clearly in FIG. 3, the indexing element 18 is subject to a torsion spring 23 maintaining it in a blocking position for immobilizing the cap 10, 10A, therefore the lever 7, 7A, in one position or another, the retraction of the indexing element 18 enabling the release of the cap 10, 10A being carried out manually against the spring 23, which also enables the automatic return of the indexing element 18 when the new position is reached.

According to another characteristic of the invention, the plate 9, 9A is shaped and sized so that it is capable of being embedded in a corresponding recess provided in the thickness of the portion 2 of the boot 4 in order to be fixed therein by means of attachment element(s) 24.

As is apparent from the description hereinabove, the angular adjusting of the lever 7, 7A in the transverse direction can be made without using any tool.

Another advantage regarding the embodiment of the indexing element is due to the fact that it plays a double role, i.e., that of indexing and that of recovering the lateral forces and preventing the displacement of the cap during impact on the lever.

What is claimed is:

1. A sports boot, such as a ski boot, comprising:

a foot insertion area, a pair of flaps at said foot insertion area, and a tightening device, to be latched and unlatched, adapted to keep said two flaps close together;

said tightening device comprising:

a first portion including an operating lever comprising at least one connection element, a plate carrying said connection element, said plate being affixed to a first of said two flaps; and a second portion located on a second of said two flaps, said second portion comprising a second connection element corresponding to said first connection element and controlled during said latching and unlatching by means of said lever which comprises a structure to align said first and second portions so as to position said first and second portions on a single working line, said operating lever being attached on said plate, which is fixed, by means of a movable cap forming a base connected to said plate by at least one assembling and guiding pin extending through a corresponding hole of said cap and an arc of a circle slot of said plate in which at least one pin is adapted to move angularly, in a transverse direction, when adjusting the alignment of the portions of said tightening device, which occurs by sliding said cap carrying said lever with respect to said base plate.

2. A sports boot according to claim 1, wherein the linkage of the cap with the plate occurs by means of a single assembling pin moving angularly in the slot of the plate with respect to a fixed axle of journal of said cap with respect to the flaps of the boot.

3. A sports boot according to claim 1, wherein the linkage of the cap with the plate occurs by means of two pins arranged symmetrically between them by allowing a sliding clearance therebetween.

4. A sports boot according to claim 1, wherein the adjusting of the angular movement of the cap, therefore of the lever, with respect to the plate occurs between two end positions of the slot of the latter, the holding in either of the selected positions being carried out by means of an intermediary indexing element arranged retractably on the plate and capable of being positioned in corresponding cutouts obtained on both sides of the cap, in its end zone directed toward the indexing element.

5. A sports boot according to claim 4, wherein the indexing element is constituted by a non-deformable finger journalled by its widened base in a corresponding housing obtained in the thickness of the boot at right angles with a narrower opening obtained in the plate, so as to confine said indexing element by its base and to enable the free overlapping of the finger extending it in said opening.

6. A sports boot according to claim 4, wherein the indexing element is subject to a torsion spring maintaining it in a blocking position for immobilizing the cap, therefore the lever, in one position or another, the retraction of the indexing element enabling the release of the cap being carried out manually against the spring, which also enables the automatic return of said indexing element when the new position is reached.

7. A sports boot according to claim 1, wherein the plate is shaped and sized so that it is capable of being embedded in a corresponding recess provided in the thickness of the portion of the boot in order to be fixed therein by means of fixing means.

* * * * *